US007640902B2

(12) United States Patent
Knecht et al.

(10) Patent No.: US 7,640,902 B2
(45) Date of Patent: Jan. 5, 2010

(54) ROTOR FOR VANE-TYPE MOTOR WITH REDUCED LEAKAGE

(75) Inventors: Andreas Knecht, Kusterdingen (DE); Dirk Pohl, Tuebingen (DE); Jan Eimert, Esslingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 302 days.

(21) Appl. No.: 11/447,608

(22) Filed: Jun. 5, 2006

(65) Prior Publication Data

US 2006/0278189 A1 Dec. 14, 2006

(30) Foreign Application Priority Data

Jun. 8, 2005 (DE) ..... 10 2005 026 553

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 5,794,578 | A * | 8/1998 | Strauss et al. | 123/90.17 |
| 6,330,870 | B1 * | 12/2001 | Inoue et al. | 123/90.17 |
| 6,363,897 | B2 | 4/2002 | Scheidt et al. | |
| 6,412,462 | B1 | 7/2002 | Lichti et al. | |
| 6,439,183 | B1 | 8/2002 | Iwasaki et al. | |
| 6,669,567 | B1 | 12/2003 | Scheidt et al. | |
| 6,945,205 | B2 * | 9/2005 | Heintzen et al. | 123/90.17 |
| 2002/0139334 | A1 | 10/2002 | Kinugawa | |
| 2005/0034693 | A1 | 2/2005 | Heintzen et al. | |

FOREIGN PATENT DOCUMENTS

| | | | |
|---|---|---|---|
| DE | 10211607 | A1 * | 10/2003 |
| EP | 1 008 729 | | 6/2000 |

* cited by examiner

*Primary Examiner*—Ching Chang
(74) *Attorney, Agent, or Firm*—Lipsitz & McAllister LLC

(57) ABSTRACT

A camshaft adjuster which operates according to the vane-type motor principle, which means being able to move to and fro within a certain angle, generally comprises a stator and a rotor. The rotor itself is provided as a composite system of at least two components. One of the components is a cover. A further component of the composite system may be denoted as the rotor core. The cover is placed on the rotor.

15 Claims, 11 Drawing Sheets

ROTOR FOR VANE-TYPE MOTOR WITH REDUCED LEAKAGE

The present disclosure relates to the subject matter disclosed in German application DE 10 2005 026 553.7 of Jun. 8, 2005, which is incorporated herein by reference in its entirety for all purposes.

BACKGROUND OF THE INVENTION

The present invention relates to a camshaft adjuster which, in a hydraulically adjustable manner and according to a vane-type motor principle, may adjust the camshafts of an internal combustion engine relative to a further shaft, such as for example the crankshaft.

There are many different types of camshaft adjusters. The most frequently used type of adjuster, at the date of filing of the present application, is that which works according to the vane-type motor principle. Two wheels which are movable relative to one another, a stator and a rotor, which are positioned coaxially, together form hydraulic chambers of which at least two chambers are contra-rotating. With the increase of the one chamber, the camshaft attached to the rotor by a central screw (other types of fastening being also known) is moved in the advanced direction, for an advanced opening time of the gas exchange valves, whilst with the increase of the other contra-rotating hydraulic chamber the camshaft is moved in the retarded direction relative to the other shaft, for a retarded opening time of the gas exchange valve. The regions denoted as hydraulic chambers may also be denoted more simply as hydraulic regions. The hydraulic medium is displaced into the various hydraulic regions via channels. In this regard, for example, channel guides are known to the applicant, in which individual channel portions are firstly guided along the camshaft itself and are transferred to the camshaft adjuster in a region of a camshaft passage of the camshaft adjuster. The channels then lead to the individual hydraulic regions, partially located within the rotor and completely surrounded by the same rotor material.

Rotor-driven hydraulic channel portions are known from U.S. Pat. No. 6,439,183 (Denso Corporation), which issued from an application filed on Oct. 1, 2001. As shown primarily in FIGS. 3, 5 and 6 of U.S. Pat. No. 6,439,183 the hydraulic channel portions allow connections to the hydraulic regions which all extend on the rotor surface and are covered by the stator inner wall. It is apparent that rotors of camshaft adjusters which have a similar appearance to those disclosed in U.S. Pat. No. 6,439,183, come from an extruded profile by cutting off along the planar faces of the retarded rotor, the channels being inserted into the planar faces of the rotor by milling. Tests on camshaft adjusters produced in this manner led to high amounts of leakage of the hydraulic medium, such as for example engine oil, primarily in the full load range. Thus unnecessary energy of the internal combustion engine is used to pump the engine oil which has escaped into the oil sump back into the hydraulic chambers. In tests, leakage rates of one liter have been shown at an operating pressure of 3 bar. In particular, during hot idling such an adjuster is shown to be the main point of oil leakage.

In addition, the patent family with the members U.S. Pat. No. 6,363,897 B (INA WÄLZLAGER SCHAEFFLER OHG), which issued from an application filed on Dec. 22, 2000, and DE 19962981 A (INA WÄLZLAGER SCHAEFFLER OHG), filed Dec. 24, 1999, discloses in its second embodiment a circular sealing washer to seal the inner chamber within the stator. The seals are located in the outer walls of the adjuster. The openings in the outer walls of the camshaft adjuster are sealed relative to the rotating parts by the leakage seals present in the walls.

Camshaft adjusters with rotors, whose channels extend completely within the rotor, are frequently provided with round drilled elongate channels. The round cross-sectional shape of the channel requires a larger drilled diameter at the same decrease in pressure as the aforementioned channel shape. The shape of the channel may produce a greater decrease in pressure which is undesirable, as decreases in the channel pressure also have a negative effect on the degree of hydraulic efficiency.

SUMMARY OF THE INVENTION

Knowing the drawbacks of one or other type of rotor, the inventor sought to provide a camshaft adjuster of an internal combustion engine which reduces the drawbacks of the two known camshaft adjusters. In this connection, numerous designs of channel were tested. Amongst others, individual channel sections of a channel were considered in order to allow optimization, section by section. In this connection, the channel section is also understood to be regions of a channel which may also encompass all the individual channel lengths of a channel.

The acknowledged difficulties are at least partially overcome by a camshaft adjuster according to the present invention. In addition, a suitable manufacturing possibility may be derived from the present invention.

A camshaft adjuster which operates according to the vane-type motor principle, which means being able to move to and fro within a certain angle, generally comprises a stator and a rotor. The motion of the vane-type motor-like camshaft adjuster may thus be denoted as angular motion. The stator is the outer sleeve which may consist of a plurality of parts. Within the stator there is at least one protrusion facing toward the center of the stator. A vane may move radially toward the protrusion and away from the protrusion. Most of the known camshaft adjusters have numerous protrusions, such as for example 5 protrusions, which are distributed, usually evenly distributed, over the periphery of the substantially circular stator and which all face toward the center of the camshaft adjuster, between which a number, generally the same number, of rotor vanes move with a reciprocating motion. The camshaft adjuster is like a planar disk of which there are two planar faces. Accordingly, the rotor is also of similar design, also having two planar faces. Between the vanes of the rotor and the corresponding protrusions and/or the stator, opposing hydraulic regions are formed into which the hydraulic medium may enter via channels. At least one of the channels is partially formed by the rotor. The rotor itself is produced as a composite system of at least two components. One of the components is a cover. A further component of the composite system may be denoted as a rotor core. The cover is placed on the rotor. The rotor core and cover may be considered as being of layered surface structure which from the side act in a sandwich-like manner. The shorter, peripheral side of the rotor core extends as far as the cover, which is noticeably flatter by comparison. The cover rests on the round face of the rotor core. In this connection, it may also partially extend into a channel. It may also be said that the second component is inserted into the first component. Principally, there is some kind of contact between the cover and the rotor core. Advantageously there may be linear contact. More advantageously, there may be multiple linear contact. The contact should be made parallel to one side. A covered channel portion is formed by the two components. It is also conceivable that the cover is a horseshoe-shaped or U- section-shaped piece along the channel portion to be covered, so that the perpendicular walls which are located at a 90° angle to the planar faces are formed by two components of the composite system of the rotor. These are the side walls of the channel portion extending in the rotor core and the side walls of the corresponding cover.

With similar channel guides on the two planar faces of the rotor, corresponding covers may also be provided for both faces of the rotor core. In this regard, it depends on the actual channel guide, whether the covers are identical to one another or whether different covers are used.

It is particularly advantageous if there are covers on the points of the rotor where a stationary part and moving part of the camshaft adjuster are in contact, the add-on parts such as the camshaft, trigger wheel or cover of the camshaft adjuster also being understood as being moving parts of the camshaft adjuster. According to an embodiment, there is a point of contact on the camshaft passage. This is the point at which the camshaft projects into the camshaft adjuster. According to a further aspect of the invention, the cover is in contact with the central screw passage. The central screw passage is the point at which the relevant central axially located screw for fixing the camshaft adjuster to the camshaft leads into the camshaft adjuster.

The channels in the camshaft adjuster have to feed the hydraulic medium, such as for example oil, from the hydraulic regions to the oil feeds, which come from another region of the drive motor. An advantageous channel guide is that the oil supply enters centrally and separately via the camshaft, is transferred by the camshaft to the channels in the camshaft adjuster, and enters the hydraulic regions from the axially positioned central oil feed, like the points of a star, over a very short path, in particular a straight path. Thus the pivoting points in the camshaft adjuster may be covered at the center by a single continuous cover. A particularly advantageous central cover is, for example, an annulus.

Pressure losses in the channels may arise from the channels having numerous branches and diverted portions. In contrast thereto, the pressure losses are reduced when the channels are designed to be sufficiently wide from the central axial inflow and with as few branches and bends as possible and enter the hydraulic regions via the planar faces of the rotor.

A further advantageous aspect is that the covers are mounted to be freely floating in the regions of the channels which they are to cover. When the pressure of the hydraulic medium increases, the covers are pressed outwardly away from the rotor core. The greater the risk of leakage due to an increase in pressure, the better the critical torsionally loaded regions are sealingly closed in the camshaft.

In order to save total construction space, in the rotor circuit an annular groove is provided in which the cover ring formed as an annular groove may be inserted. As a result, the rotor core and its corresponding lateral cover, which only covers part of the rotor core, form a single surface.

A further advantage is that suitable materials are selected. Sintered metal is particularly suitable for the rotor core, in which the appropriate channels have already been inserted during the sintering process. The seals may advantageously be manufactured from plastics material, in particular highly resistant plastics material. By the choice of material the rotor core may be advantageously mounted on the camshaft and continue to operate for the desired running performance, whilst due to their synthetic properties, the seals may develop particularly advantageous sealing properties.

The corresponding manufacturing method for producing a camshaft adjuster according to the invention comprises the steps of producing a rotor core, inserting an appropriate cover and the formation of the entire composite system in the stator housing. In particular with sintered rotor cores, the channels which are open toward the surface may be produced in the rotor cores at the same time as the sintering process. With the use of extruded sections, the rotor core is cut to length at its appropriate thickness from the extruded section and the channels are inserted in the first processing step, for example by milling or stamping.

BRIEF DESCRIPTION OF THE DRAWINGS

The invention may be better understood with reference to the accompanying Figures.

DETAILED DESCRIPTION

Figure 1:
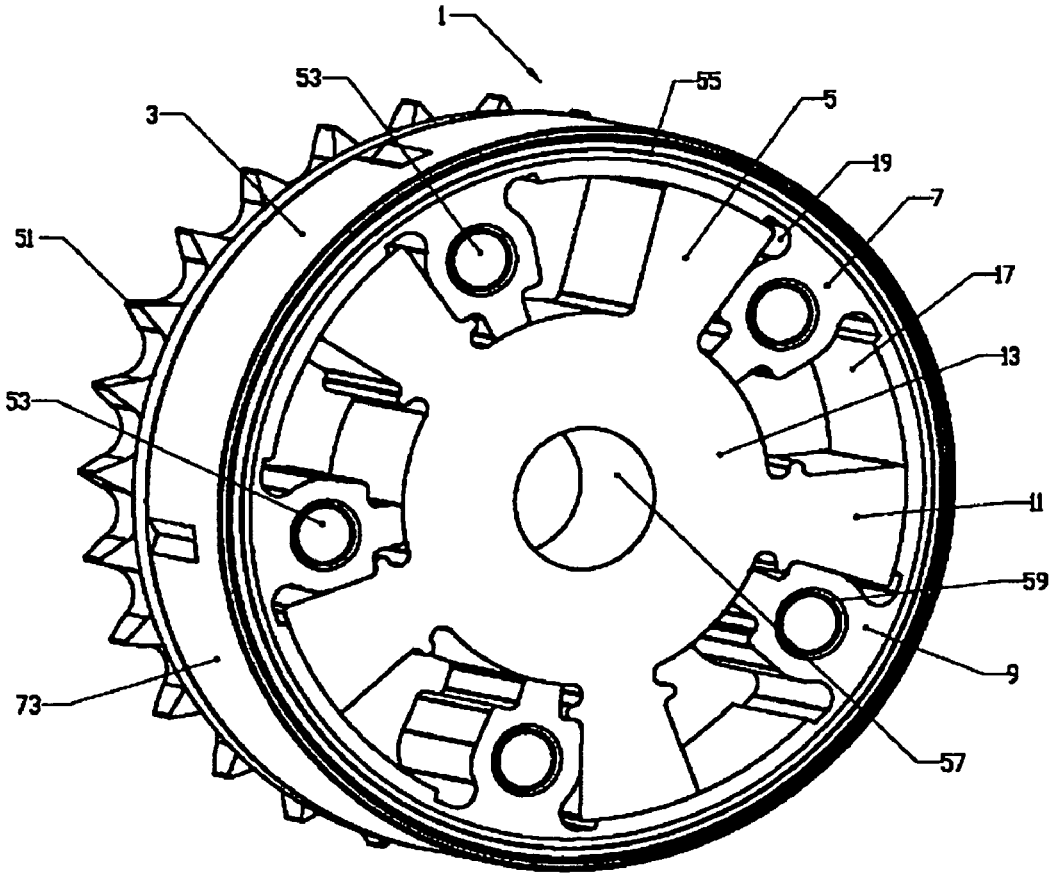
FIG. 1 shows a perspective of an open camshaft adjuster.
Figure 2:
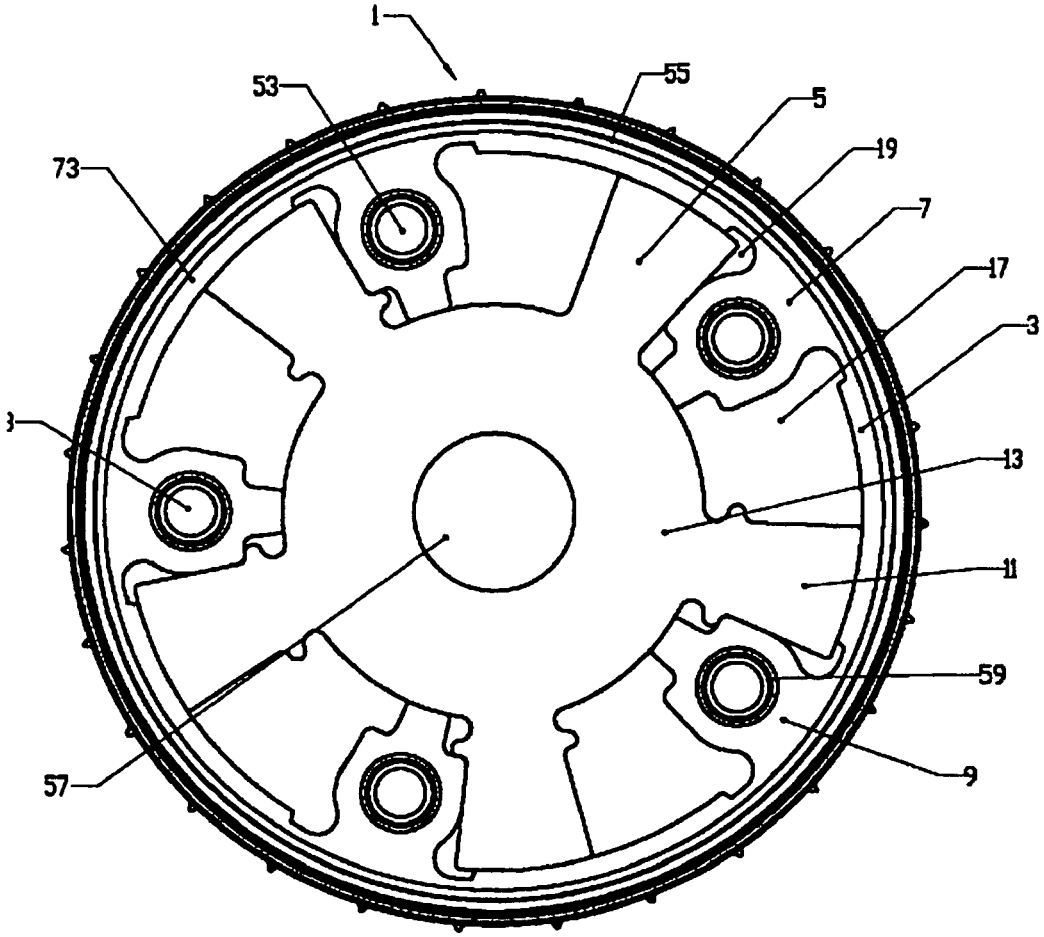
FIG. 2 shows a lateral view of an open camshaft adjuster.

FIG. 1 and FIG. 2 show an open camshaft adjuster 1 in an overall view. In the stator 3, a rotor 5 is located of which the vane 11 is mounted to be movable to and fro between individual protrusions 7, 9 by means of hydraulic pressure. The one face of the stator 3 may optionally comprise a further sprocket 51. The views of the camshaft adjuster are illustrated with an open stator of the stator housing 73 in FIGS. 1 and 2. The stator housing 73 may be produced as a dish in a single piece with integral sprocket 51 or in a plurality of parts in the form of a receiving ring which is covered on one side by the sprocket 51. The rotor 5 may be formed with an axial recess for a means for fastening the rotor to the output shaft, for example a central screw guide 57 as shown in FIG. 1. The disk-like components of the camshaft adjuster may be held together by countersunk screws distributed over their circumference which may respectively reach the other side of the stator housing 73 through the protrusion bores 53 in the protrusions 7, 9. Seals may be optionally inserted at different points of the camshaft adjuster 1 in order to seal, during operation, the hydraulic fluids of the first hydraulic region 17 or the second hydraulic region 19 relative to the surroundings. By way of example, a peripheral stator seal 55 peripherally arranged in the edge region of the stator 3 and annular protrusion bore seals 59 located around the protrusion bores 53 are indicated. The rotor 5 which has a star-shaped appearance with its vanes 11 to separate the two hydraulic regions 17, 19, has dihedral faces 13, 15. During operation, the stator 3 and the rotor 5 move almost continuously, whilst the oil of the hydraulic regions 17, 19 should be able to be supplied and discharged in a manner which maintains the chamber as fluid-tight as possible.

Figure 3:
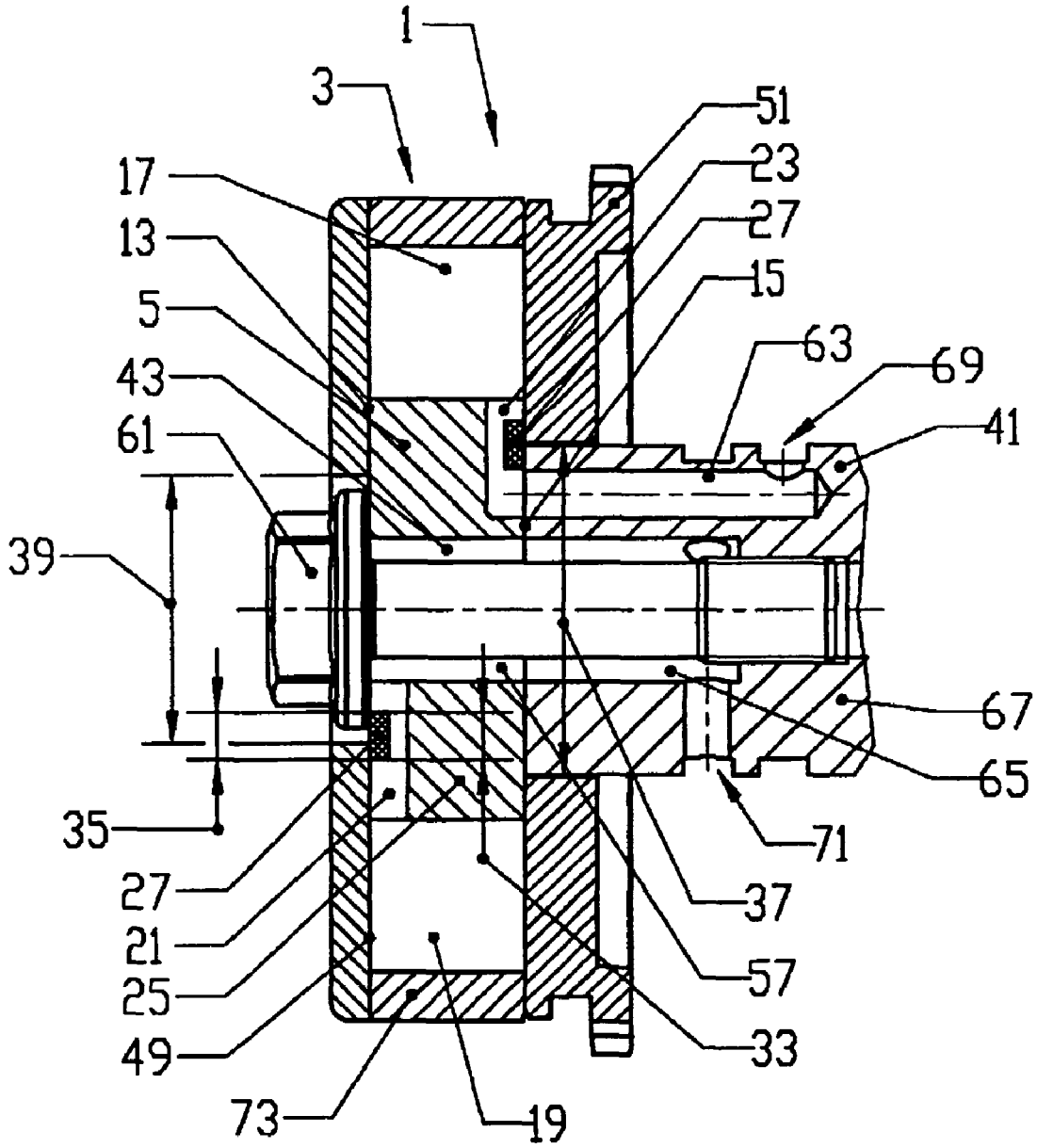
FIG. 3 shows a camshaft adjuster according to the invention, built onto a camshaft in longitudinal section.

The camshaft adjuster 1 shown in FIG. 3, comprising a stator 3 and a rotor 5, has been illustrated in a view through a central screw 61 on the camshaft 67. In addition to the rotor 5, the stator housing 73 also surrounds the various hydraulic regions 17, 19. In the embodiment shown, the camshaft 67 is used, amongst other things, to guide the pressurized hydraulic medium via a first groove 69 and a second groove 71, via first and second feed channels 63, 65 extending in the camshaft and via a first and a second channel 21, 23 to the hydraulic regions 17, 19. The multi-tiered stator housing 73 shown in FIG. 3 is sealed by the sprocket 51 designed as a cover which is located on the camshaft side such that the camshaft 67, engaging the rotor 5 through the camshaft passage 37 by means of the central screw 61 which is screwed into the end of the camshaft 67, engaging the rotor 5 through the central screw passage, produces a frictional connection between the camshaft 67 and the one planar face of the rotor. In the embodiment provided, the central screw guide 57 is provided with a larger diameter than the shank diameter of the central screw 61 so that the central screw 61 flushes round, so to speak, oil carried by the hydraulic medium in the diameter difference used as an oil feed 43, a portion of the oil channel may lead to one of the planar faces. Further channel portions, such as for example 33, extend partially within the rotor core 31 and bridge over points of contact 35 which are provided between rotating parts, such as for example the central screw 61 and relatively quasi-stationary parts such as a stator housing 73, the transition being present between the first and second channel 21, 23 extending on the edge of the rotor core 31. The regions 41 provided as rotary passages are sealingly sealed by the second component 27 of the multi-tiered rotor 5 of sandwich-like construction in a manner which is insensitive to friction and torsionally resistant. The first component 25 (e.g., the rotor core) and the second component 27 (e.g., the cover(s)), optionally with further components, form the rotor 5. The second component 27 may be inserted at least partially into the first component 25 such that apertures produced by just a few holes through the channel guide of the first and second channel 21, 23, produce the interrupted first and second planar faces 13, 15 of the rotor 5. The planar faces 13, 15 of the rotor 5 brush against lines of contact, which may also be individual channel portions 33, and against stator side walls 49, in particular the inner stator side walls.

Figure 4:
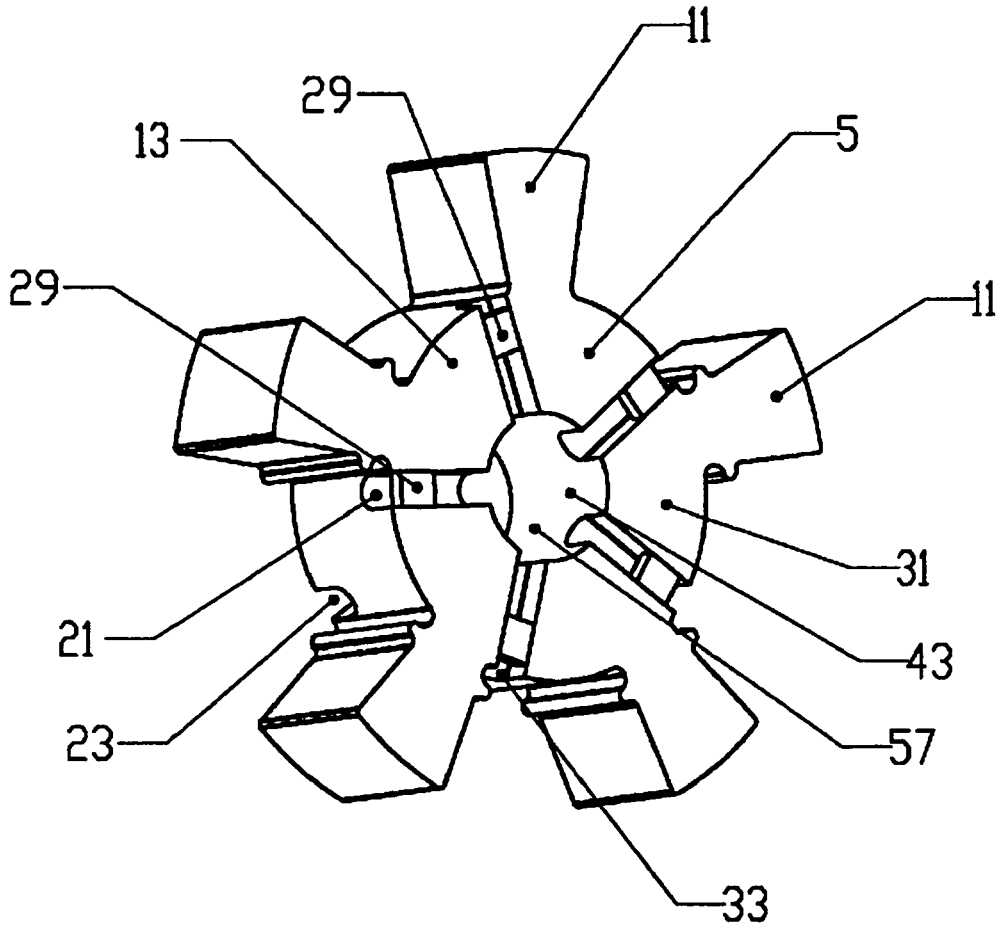
FIG. 4 shows a first embodiment of a rotor according to the invention.
Figure 5:
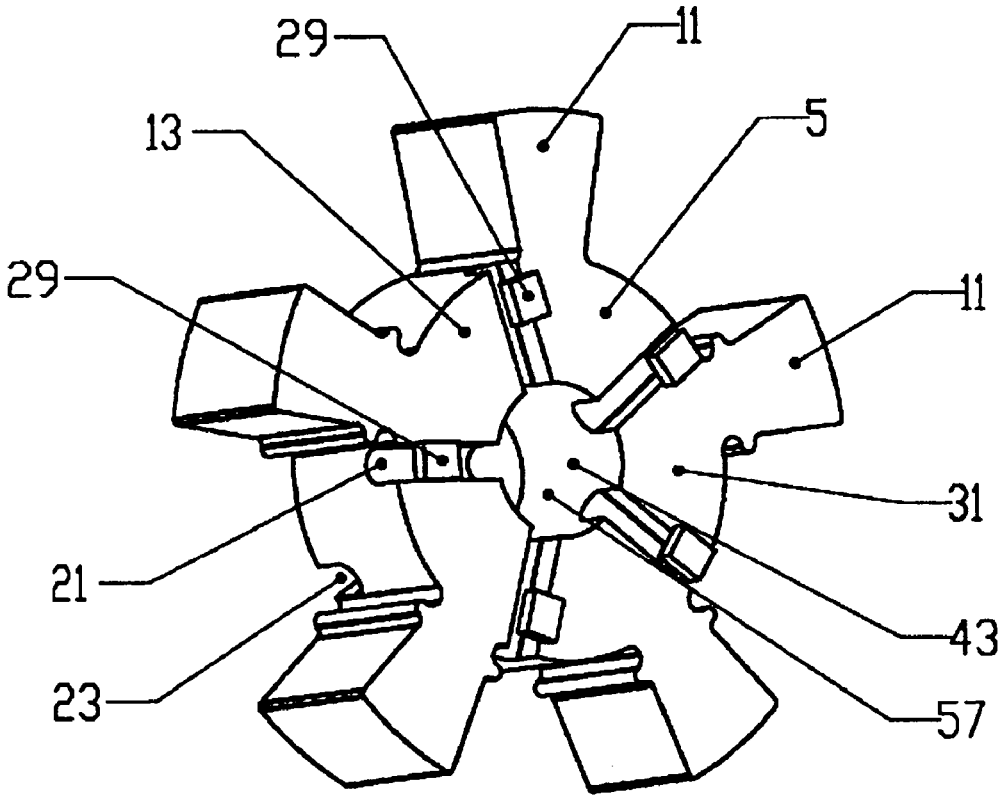
FIG. 5 shows a second embodiment of a rotor according to the invention.

Six different embodiments of rotor channel guides as components constructed according to the invention with large, transverse surfaces may be derived from FIGS. 4, 5, 6, 7, 8 and 9. In FIG. 4, the oil feed 43 enters the expanded portions between the vanes 11, moving out radially from the center of the rotor 5 in part of the central screw guide 57 and moving outwards straight in the direction of the vanes 11 along the first planar face 13 of the rotor 5. The channel 21 guided in the edge regions of the rotor 5 opens out at the circular arc shaped connecting portions between the vanes of the rotor. The channel 21 ends at a position relative to the channel 23 offset by the angle of slippage and/or adjustment and which, located on the rear face, the second planar face 15 of the rotor 5, may provide the other hydraulic region. The rotor 5 according to FIG. 5 is of substantially similar design to the rotor 5 of FIG. 4. The two rotors 5 comprise hammer-like vanes 11 with widened sealing lengths on their radial external vane ends. However, the rotors 5 of FIG. 4 and FIG. 5 differ in the type of cover 29 and/or in the cooperation between the covers 29 and the channels 21. The covers 29 which in FIG. 4 and FIG. 5 are small, quadrilateral, preferably square plates with such lengths which are as long as the contact points between the movable and stationary part of the camshaft adjuster 1 plus an additional remaining sealing portion. In FIG. 4, the covers 29 are precision-fit clamp covers which are positively inserted in the channel 21 and with an interference fit in the rotor core 31. In FIG. 5, the covers 29 are floatable, fixed in a relative position to the rotor 5, height adjustable, and may be pressed outwardly under pressure against the stator side wall 49. The two FIGS. 4, 5 show in a three-dimensional view the one planar face 13 of the rotor 5 whilst the channel 23 offset by the angle of rotation of the rotor 5 is only visible in outline on the rear opposing second planar face 15 through its channel end. The two channels 21, 23 extend within the edge regions of the rotor core 31. On the face which faces the interior of the rotor, the channels 21, 23 have semi-circular channel floor regions which open into longitudinal walls extending parallel to one another. The oil feed 43 extends along and surrounds the central screw guide 57 in order to diverge radially into the channels 21 in a star shape at the end of the central screw guide. It is advantageous to design the same number of covers 29 as channels when it is desirable to save on materials, as only the critical regions particularly affected by leakage are sealed.

Figure 6:
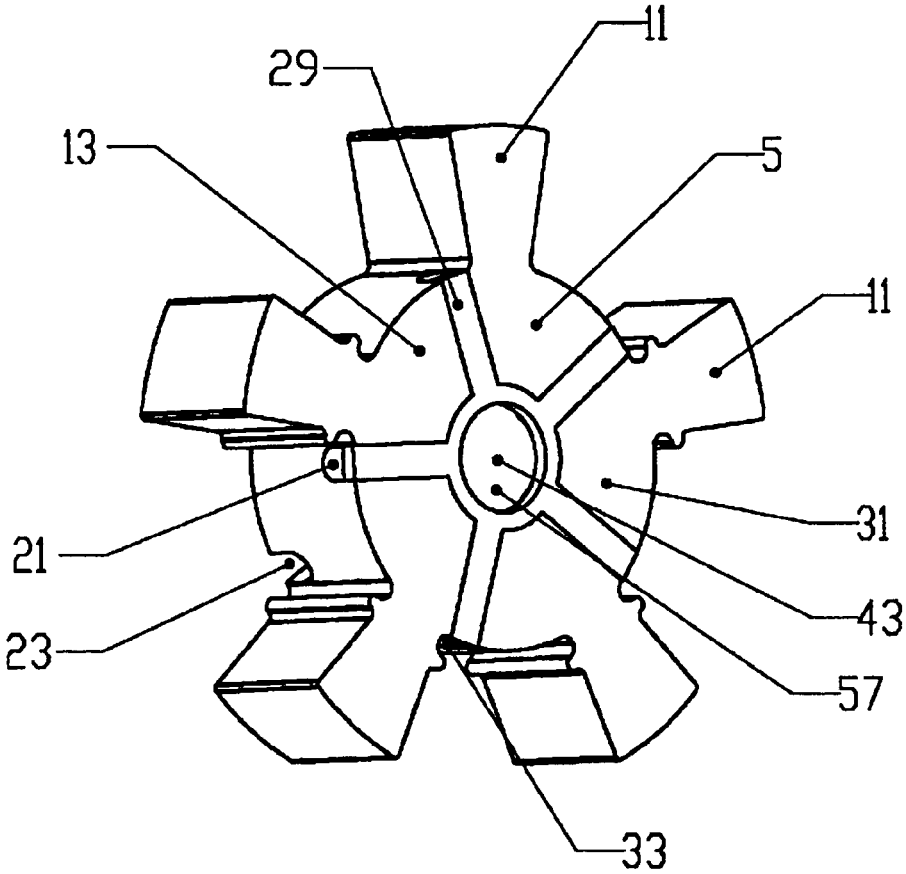
FIG. 6 shows a third embodiment of a rotor according to the invention.
Figure 7:
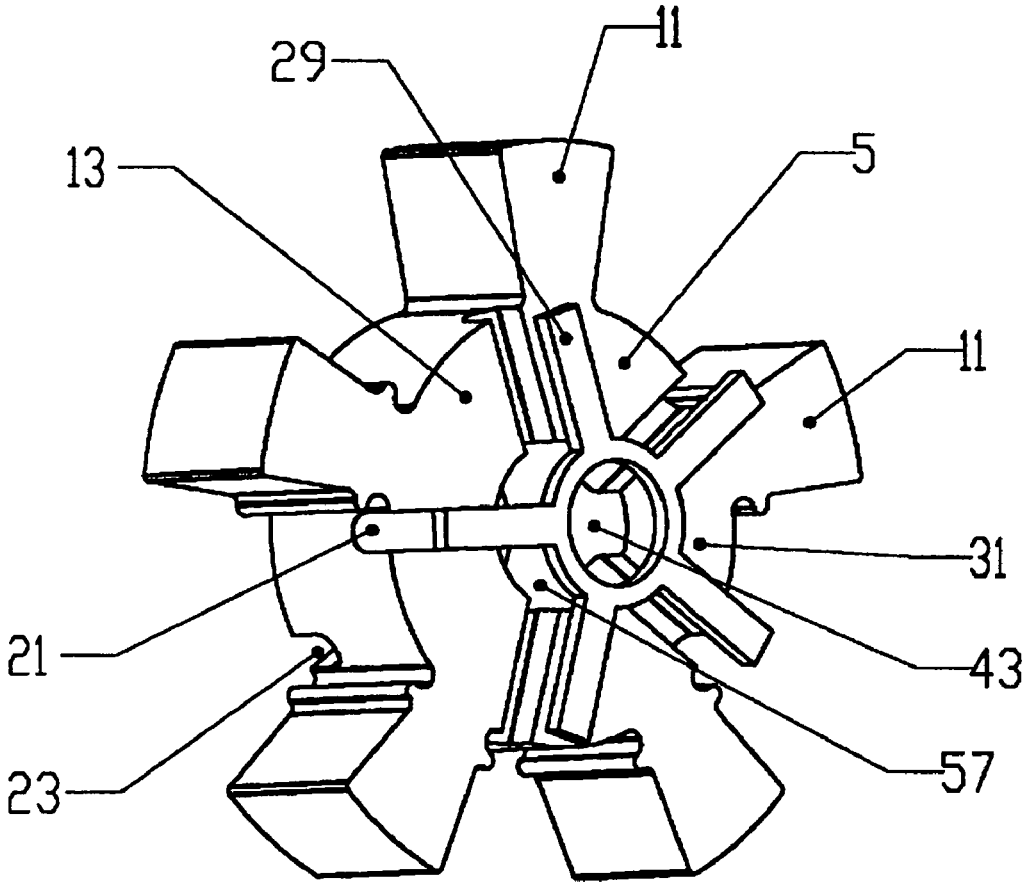
FIG. 7 shows a fourth embodiment of a rotor according to the invention.

FIG. 6 and FIG. 7 are very similar to one another. FIG. 7 shows the pressure-reactive, positionable cover 29 which can be lifted from the channel floor when the hydraulic medium is pressurized. In FIG. 6 the cover 29 is in a fixed position on the surrounding rotor core 31 of the rotor 5. The cover 29 is made of one piece. It bridges all channels 21 and is held together by a connecting ring in the center of the individual channel covers. The one-piece cover 29 according to FIG. 6 and FIG. 7 is advantageous when it is desirable to keep production costs as low as possible, because all channels 21 are completely covered in one operation.

Figure 8:
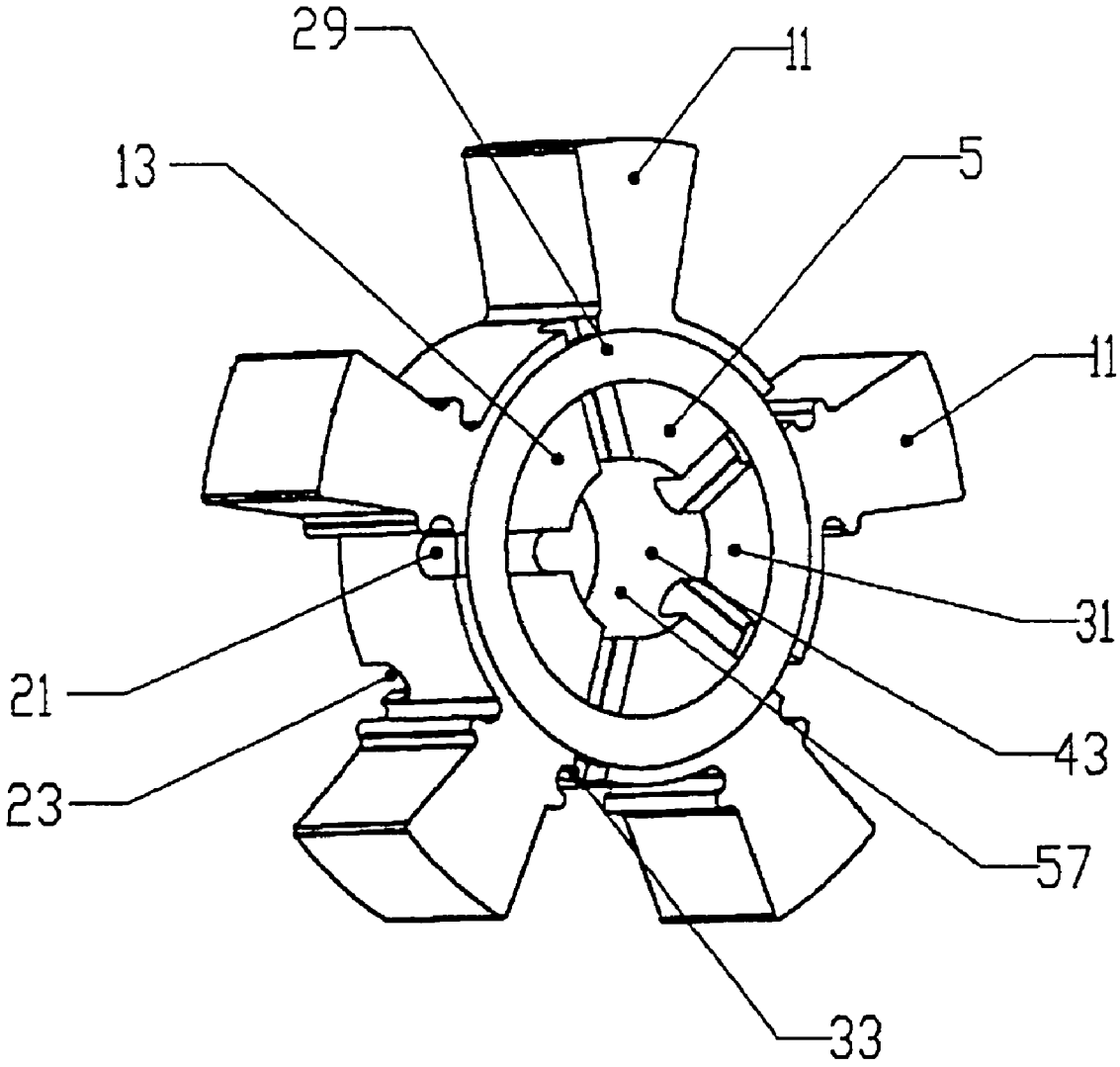
FIG. 8 shows a fifth embodiment of a rotor according to the invention.
Figure 9:
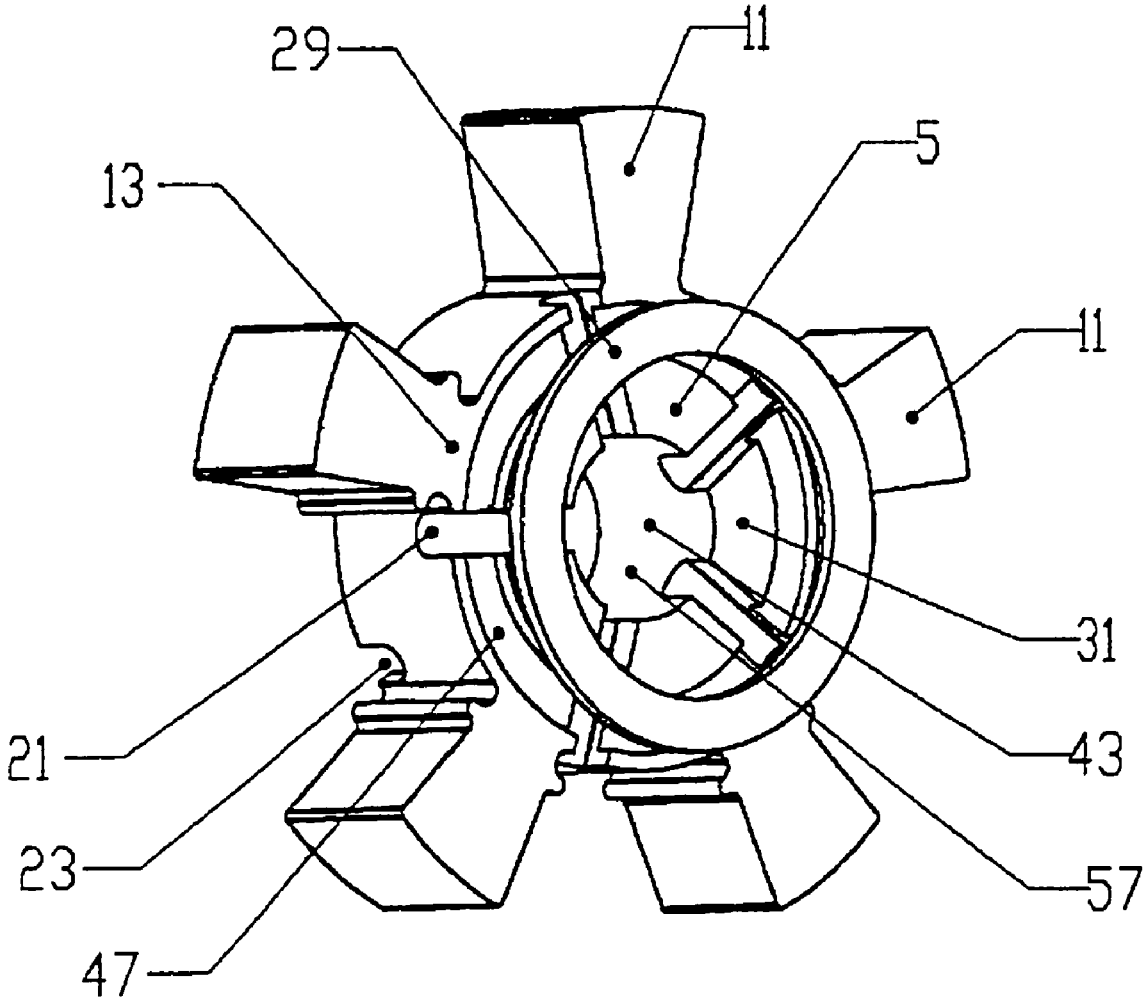
FIG. 9 shows a sixth embodiment of a rotor according to the invention.

The shape of the cover 29 according to FIG. 8 and FIG. 9 is an annulus which is located in an annular groove 47 which extends circumferentially over the uncovered surface of the one face 13 of the rotor core 31, in the vicinity of the vanes 11. Only the individual portions of the channels 21 are covered. The rotor 5 according to FIG. 8 is provided with a cover 29 which is of a precise fit, whilst the rotor 5 according to FIG. 9 is provided with a flexible, movable cover 29.

Figure 10:
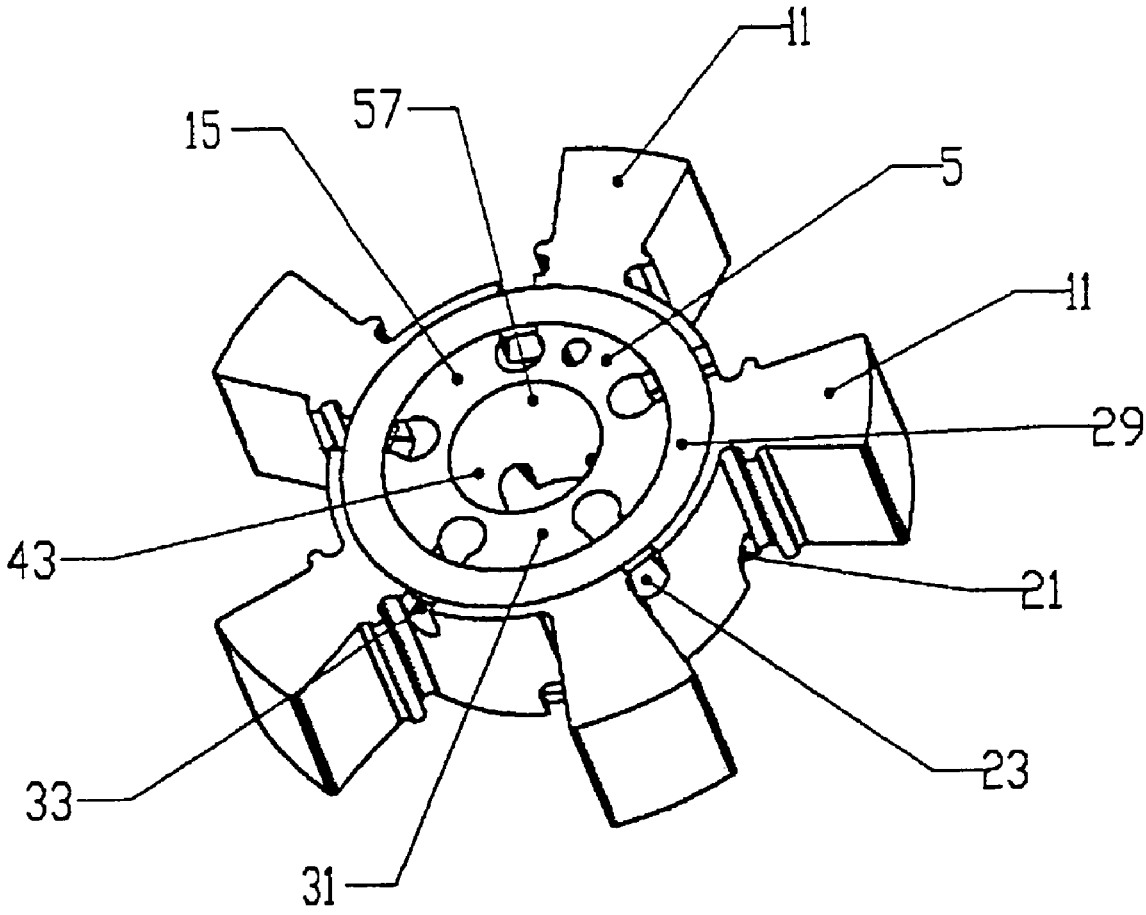
FIG. 10 shows a perspective view of a rotor according to the invention.

FIG. 10 shows the other face 15 of the rotor 5, of which the cover 29 bridges the channel portion 33 of the channel 23 which is located on a different radius, for example a larger radius, from the cover 29 on the first face 13 of the rotor 5. The oil feed channels are located Outside the central oil feed 43 of the front face 13 of the rotor 5, radially approaching the vanes 11 of the rotor core 31. To save on the number of parts, the cover 29, designed as an annulus, has the same diameter and the same radius as the annular cover of FIG. 8 or 9.

Figure 11:
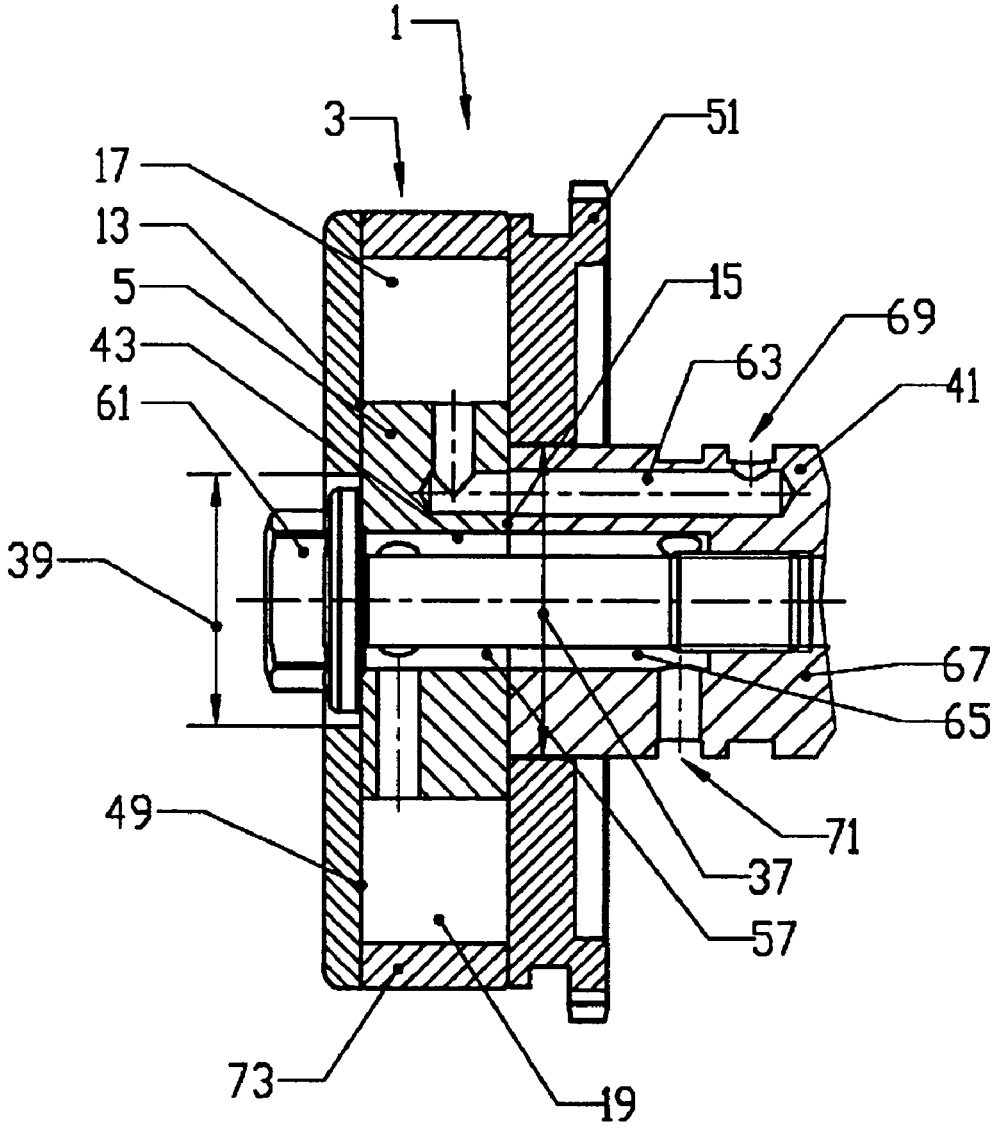
FIG. 11 shows a known camshaft adjuster.

In FIG. 11 a camshaft adjuster 1 of the known type is shown screwed to a stator 3 and a rotor 5 by an axially extending central screw 61 on a camshaft 67 which presses the rotor 5 non-positively via the head of the central screw 61 in an oil tight manner to the first and second feed channel 63, 65. The central screw passage 39 is present on the side of the screw-head of the central screw 61, a camshaft passage 37 is present on the other face 15 of the rotor 5, the face 13 facing away from the central screw passage 39. The stator 3 is made up of a plurality of components including the integral sprocket 51 and stator housing 73. The rotor 5 brushes against the stator side wall 49 during its angular displacement. The oil feed 43, which extends around the central screw 61, supplies the hydraulic medium to the hydraulic regions 17 or 19 via channels which, in the present embodiment, are completely internal. The hydraulic medium is transferred by the camshaft 67 to the camshaft adjuster 1 via the two grooves 69, 71 which are located in the camshaft 67.

The channel guide shown in FIGS. 4 to 9 may also be combined with one of the two channels, shown in FIG. 11, in a rotor core 31.

The invention disclosed above may also be denoted, using another term, as a floating ring seal for rotor channels which sealingly and floatingly covers the pressure chamber feed channels, located during operation in the longitudinal faces of the rotor, relative to the rotary passages of the rotor connections, minimizing leakage relative to the cavities in the engine region which are parallel to the rotor. In this regard, the invention is characterized according to one principal aspect in that with increasing pressure, i.e. generally at higher rotational speeds of the oil pump of the internal combustion engine, the sealing function increases further and, as a result, the leakage is reduced.

It should be appreciated that, within the scope of this description, only individual embodiments are explained which are intended to clarify the general inventive concepts without the invention being restricted to the embodiments explained. In this regard it is also reasonable that suitable choices of material which have the same composite system behavior, such as for example plastics-plastics, metal-metal, etc. belong to the invention. The actual channel designs of rotors according to the invention are similarly not restricted to the embodiments disclosed.

TABLE 1

| | |
|---|---|
| 1 | Camshaft adjuster |
| 3 | Stator |
| 5 | Rotor |
| 7 | First protrusion |
| 9 | Second protrusion |
| 11 | Vane |
| 13 | First planar face of the rotor |
| 15 | Second planar face of the rotor |
| 17 | First hydraulic region |
| 19 | Second hydraulic region |
| 21 | First channel |
| 23 | Second channel |
| 25 | First component |
| 27 | Second component |
| 29 | Cover |
| 31 | Rotor core |
| 33 | Channel portion |
| 35 | Contact point |
| 37 | Camshaft passage |
| 39 | Central screw passage |
| 41 | Rotary passage |
| 43 | Oil feed |
| 47 | Annular groove |
| 49 | Stator side wall |
| 51 | Sprocket |
| 53 | Protrusion bore |
| 55 | Peripheral stator seal |
| 57 | Central screw guide (in the rotor) |
| 59 | Protrusion bore seal |
| 61 | Central screw |
| 63 | First feed channel |
| 65 | Second feed channel |
| 67 | Camshaft |
| 69 | First groove, preferably peripheral |
| 71 | Second groove, preferably peripheral |
| 73 | Stator housing |

What is claimed is:

1. A camshaft adjuster according to the vane-type motor principle, comprising:

a stator which has at least two protrusions facing a center of the stator, a rotor which has at least one vane located in a vicinity of the at least two protrusions and which is angularly movable, said rotor having a first and a second planar face, at least two contra-rotating hydraulic regions being formed between said at least one vane and the at least two protrusions by an angular movement of the rotor, and channels to the hydraulic regions, one of the channels being formed at least partially by a central screw passage of the rotor, said central screw passage of the rotor accommodating a central screw for attaching the rotor to a camshaft and having a diameter that is larger than a diameter of said central screw, wherein:

the rotor is provided as a composite system of at least two components, a flat cover and a rotor core which upon contact with each other form a covered channel portion parallel to one of said planar faces, and the flat cover sealingly covers at least one point of the rotor which is in contact with both a stationary part of the camshaft adjuster and a moving part of the camshaft adjuster, said moving part of the camshaft adjuster including at least one of the camshaft, a trigger wheel and a camshaft adjuster cover.

2. A camshaft adjuster as claimed in claim 1, wherein the first component is the rotor core, the second component is the cover and the second component is inserted into the first component.

3. A camshaft adjuster as claimed in claim 1, wherein channels extend parallel to the first and second face in the rotor and which are covered by one respective component as a covered channel.

4. A camshaft adjuster as claimed in claim 1, wherein said cover covers at least one of a camshaft passage, the central screw passage, and rotary passages between the rotor and stator.

5. A camshaft adjuster as claimed in claim 1, wherein channels lead from the hydraulic regions to the central screw passage axially positioned in the rotor, and which channels form the covered channel portions by means of a cover divided like the points of a star linked together by an annulus.

6. A camshaft adjuster as claimed in claim 1, wherein the channels lead to the hydraulic regions from axial feed channels, the channels extending in the radial direction over a shortest possible path from the feed channels, without branches and bends in the planar faces of the rotor.

7. A camshaft adjuster as claimed in claim 1, wherein:

the composite system comprises at least two outer covers and said rotor core, and the outer covers of the composite system are plastics material elements and the rotor core located between the outer covers of the composite system consists of a sintered metal.

8. A camshaft adjuster as claimed in claim 1, wherein said flat cover is in contact with the central screw passage for minimizing leakage.

9. A camshaft adjuster according to the vane-type motor principle, comprising:

a stator which has at least two protrusions facing a center of the stator, a rotor which has at least one vane located in a vicinity of the at least two protrusions and which is angularly movable, said rotor having a first and a second planar face, at least two contra-rotating hydraulic regions being formed between said at least one vane and the at least two protrusions by an angular movement of the rotor, and channels to the hydraulic regions, one of the channels being formed at least partially by the rotor, wherein:

the rotor is provided as a composite system of at least two components, a cover and a rotor core which upon contact with each other form a covered channel portion parallel to one of said planar faces; and the channels are floating channels which, when filled by a pressurized hydraulic medium, sealingly press the cover away from the rotor core outwardly to a stator side wall.

10. A camshaft adjuster as claimed in claim 9, wherein the cover covers at least one point of the rotor which is in contact with a stationary part and a moving part of the camshaft adjuster, said moving part of the camshaft adjuster including at least one of the camshaft, a trigger wheel and a camshaft adjuster cover.

11. A camshaft adjuster as claimed in claim 9, wherein:

the composite system comprises at least two outer covers and said rotor core, and the outer covers of the composite system are plastics material elements and the rotor core located between the outer covers of the composite system consists of a sintered metal.

12. A camshaft adjuster according to the vane-type motor principle, comprising:

a stator which has at least two protrusions facing a center of the stator, a rotor which has at least one vane located in a vicinity of the at least two protrusions and which is angularly movable, said rotor having a first and a second planar face, at least two contra-rotating hydraulic regions being formed between said at least one vane and the at least two protrusions by an angular movement of the rotor, and channels to the hydraulic regions, one of the channels being formed at least partially by the rotor, wherein:

the rotor is provided as a composite system of at least two components, a cover and a rotor core which upon contact with each other form a covered channel portion parallel to one of said planar faces;

the channels lead from the hydraulic regions to a central oil feed axially positioned in the rotor, and which channels form the covered channel portions by means of a cover divided like the points of a star linked together by an annulus; and the annulus is located in an annular groove which extends sealed over the entire face of the rotor.

13. A camshaft adjuster as claimed in claim 12, wherein the cover covers at least one point of the rotor which is in contact with a stationary part and a moving part of the camshaft adjuster, said moving part of the camshaft adjuster including at least one of the camshaft, a trigger wheel and a camshaft adjuster cover.

14. A camshaft adjuster as claimed in claim 12, wherein:

the composite system comprises at least two outer covers and said rotor core, and the outer covers of the composite system are plastics material elements and the rotor core located between the outer covers of the composite system consists of a sintered metal.

15. A method for producing a camshaft adjuster working in accordance to the vane-type motor principle, comprising:

providing a rotor core with channels open toward a surface of the rotor, the rotor having at least one vane in the vicinity of at least two protrusions and which is angularly movable, one of the channels being formed at least partially by a central screw passage of the rotor, said central screw passage of the rotor accommodating a central screw for attaching the rotor to a camshaft and having a diameter that is larger than a diameter of said central screw, inserting a flat cover in at least one annular groove of the rotor core, the flat cover and the rotor core which upon contact with each other form a covered channel portion parallel to a planar face of said rotor core, the flat cover sealingly covering at least one point of the rotor which is in contact with both a stationary part of the camshaft adjuster and a moving part of the camshaft adjuster, said moving part of the camshaft adjuster including at least one of the camshaft, a trigger wheel and a camshaft adjuster cover, and inserting a composite system comprised of the rotor core and the flat cover into a stator housing.

* * * * *